US007682182B2

(12) United States Patent
Kondo et al.

(10) Patent No.: US 7,682,182 B2
(45) Date of Patent: Mar. 23, 2010

(54) ELECTRIC CONNECTOR

(75) Inventors: Hayato Kondo, Yao (JP); Takayuki Nagata, Yao (JP)

(73) Assignee: Hosiden Corporation, Yao-shi (JP)

( * ) Notice: Subject to any disclaimer, the term of this patent is extended or adjusted under 35 U.S.C. 154(b) by 2 days.

(21) Appl. No.: 12/172,511

(22) Filed: Jul. 14, 2008

(65) Prior Publication Data

US 2009/0023336 A1 Jan. 22, 2009

(30) Foreign Application Priority Data

Jul. 20, 2007 (JP) ..... 2007-190146

(51) Int. Cl.
*H01R 13/627* (2006.01)

(52) U.S. Cl. ..... 439/353; 439/607

(58) Field of Classification Search ..... 439/353, 439/357, 352, 607, 608, 610
See application file for complete search history.

(56) References Cited

U.S. PATENT DOCUMENTS 6,280,209 B1 * 8/2001 Bassler et al. ..... 439/101
6,811,439 B1 * 11/2004 Shin-Ting ..... 439/607
6,817,998 B2 * 11/2004 LaHaye ..... 606/11
6,997,733 B2 * 2/2006 Peng ..... 439/353
7,175,465 B1 * 2/2007 Tsai ..... 439/352
7,422,465 B2 * 9/2008 Watanabe et al. ..... 439/353

FOREIGN PATENT DOCUMENTS

JP 06-135826 6/1993

* cited by examiner

*Primary Examiner*—Alexander Gilman
(74) *Attorney, Agent, or Firm*—Kratz, Quintos & Hanson, LLP

(57) ABSTRACT

An electric connector includes an insulative housing of such a shape as to be engageable on a front side thereof with a mating connector, a contact group including a plurality of contacts, a shield cover for surrounding outer surfaces of the housing, and a metal shield plate for impedance matching. The contacts are arranged in a widthwise direction of the connector so as to correspond to contacts of the mating connector. Proximal ends of the contacts are held and fixed in terminal insertion holes formed in the housing and leading ends of the contacts being exposed from the terminal insertion holes. The metal shield plate has a width thereof corresponding to a lateral length of the contact group and is disposed between the shield cover and the contact group and facing the contact group.

10 Claims, 10 Drawing Sheets

ELECTRIC CONNECTOR

The present application claims priority under 35 U.S.C. §119 of Japanese Patent Application No. 2007-190146 filed on Jul. 20, 2007, the disclosure of which is expressly incorporated by reference herein in its entity.

BACKGROUND OF THE INVENTION

1. Field of the Invention

The present invention relates to electric connectors used in cables for signal transmission.

2. Description of the Related Art

Electric connecters for use in latest personal computers and the like are required to provide matched impedances and low crosstalk. In this regard, connectors having microstrip line structures have been proposed (see, e.g., Japanese Unexamined Patent Publication No. 05-135826).

In a connector of the above-mentioned conventional example, however, contact portions at leading ends of contacts that are press fitted and fixed in a housing are disposed outside of a dielectric housing and fully exposed to the air; in this respect, the conventional example does not have a microstrip structure in a strict sense, and sufficient impedance matches are not obtained therein.

That is, the press-fitted and fixed portions at the proximal ends of the contacts are covered with plastics material of the housing, while the contact portions at the leading ends of the contacts are surrounded by the air. The air is about one third smaller in permittivity than plastics material. Hence capacitance at the contact portions of the contacts is smaller than that at the press-fitted and fixed portions, resulting in impedance mismatch. Due to this impedance mismatch, the conventional connector is disadvantageous in terms of transmission characteristics.

Particularly, since is it impossible to cover the contact portions of the contacts with plastics material or to remove plastics material surrounding the press fitted and fixed portions. Consequently, impedance matching must be effected through other methods, which raises costs accordingly.

SUMMARY OF THE INVENTION

The present invention was made in view of the foregoing circumstances. It is an object of the present invention to provide an impedance tunable electric connector at low cost.

An electric connector according to the present invention includes: an insulative housing of such a shape as to be engageable on a front side thereof with a mating connector; a contact group including a plurality of contacts, the contacts being arranged in a widthwise direction of the connector so as to correspond to contacts of the mating connector, proximal ends of the contacts being held and fixed in terminal insertion holes formed in the housing and leading ends of the contacts being exposed from the terminal insertion holes; a shield cover for surrounding outer surfaces of the housing; and a metal shield plate for impedance matching, with a width thereof corresponding to a lateral length of the contact group, the shield plate being disposed between the shield cover and the contact group and facing the contact group.

Since the above-described electric connector is structured such that the shield plate is disposed to face the leading end of the contact group, capacitance at the leading end of the contact group is increased to a level approximately equal to the capacitance at the proximal end of the contact group, so that impedance can be matched throughout the contacts. Further, since what is needed is only the addition of the shield plate, there is provided a connector having a very simple structure with improved transmission characteristics at low cost.

If the contact group comprising first and second rows of contacts shifted in phase, the shield plate may include a first shield plate, facing the first row of contacts, and a second shield plates, facing the second row of contacts and being shifted in position from the first shield plate by the same distance as the phase shift between the first and second rows of contacts.

The shield cover is preferably contactable with an outer peripheral shield of the mating connector when the mating connector is engaged with the housing.

In addition to the above-described structures, the electric connector of the present invention may have a recess formed in an outer surface of the housing to contain and position the shield plate.

As described above, since the electric connector has a structure in which the shield plate is positioned by and contained in the recess of the housing, the electric connector is further advantageous in that the shield plate can be fitted very easily, so that the assembly of the entire structure is facilitated. Moreover, the electric connector requires no special component to attach and position the shield plate, so that costs can be reduced also in this aspect.

The shield plate is preferably provided with a spring member contactable with an inner surface of the shield cover when the shield plate is contained in the recess. In this case, electrical conduction between the shield cover and the shield plate is established simply by attaching the shield cover around the housing, obviating the need of special wiring operation, whereby costs can be further reduced.

In addition to the above-described structure, the electric connector of the invention may have the shield plate formed integrally with the shield cover, where the shield plate may be formed by extending and bending a portion of the shield cover.

As described above, since the electric connector has the shield plate integrally provided with the shield cover, the electric connector is still further advantageous in that the shield plate needs not be prepared separately, so that the number of components can be reduced and the cost can be reduced accordingly.

In the electric connector of the invention, in addition to the above-described structure, the contacts may include a particular contact subject to impedance tuning and other contacts. In this case, a portion of the shield plate facing the particular contact may be different in length in an insertion direction of the mating connector from the remaining portion of the shield plate facing the other contacts in accordance with an impedance difference to be tuned.

The electric connector is thus adapted to adjust the capacitance of the particular contact just by changing the shape of the shield plate. Consequently, the electric connector is still further advantageous in that impedance can be easily matched between the particular contact and the other contacts, whereby the transmission characteristics of the connector can be further improved with reduced costs.

In the electric connector according to the present invention, in addition to the above-described structure, the contacts may include a particular contact subject to impedance tuning. In this case, a portion of the shield plate facing the particular contact is different in height position from a remaining portion of the shield plate in accordance with an impedance difference to be tuned.

The electric connector is thus adapted to adjust the capacitance of the particular contact just by changing the height of the shield plate in part. Consequently, the electric connector is still further advantageous in that impedance can be easily matched between the particular contact and other contacts of the contact group, whereby the transmission characteristics of the connector can be further improved with reduced costs.

DETAILED DESCRIPTION OF THE PREFERRED EMBODIMENTS

An electric connector according to an embodiment of the present invention will be described below with reference to the drawings.

As shown in FIGS. 1 to 7, the electric connector described herein is a plug connector to be attached to a leading end of a bulk cable (a cable 70) for high-speed signal transmission. The electric connector includes a housing 10, contact groups 20*a* and 20*b*, a shield cover 30, shield plates 40*a* and 40*b*, and a case 60.

Figure 1:
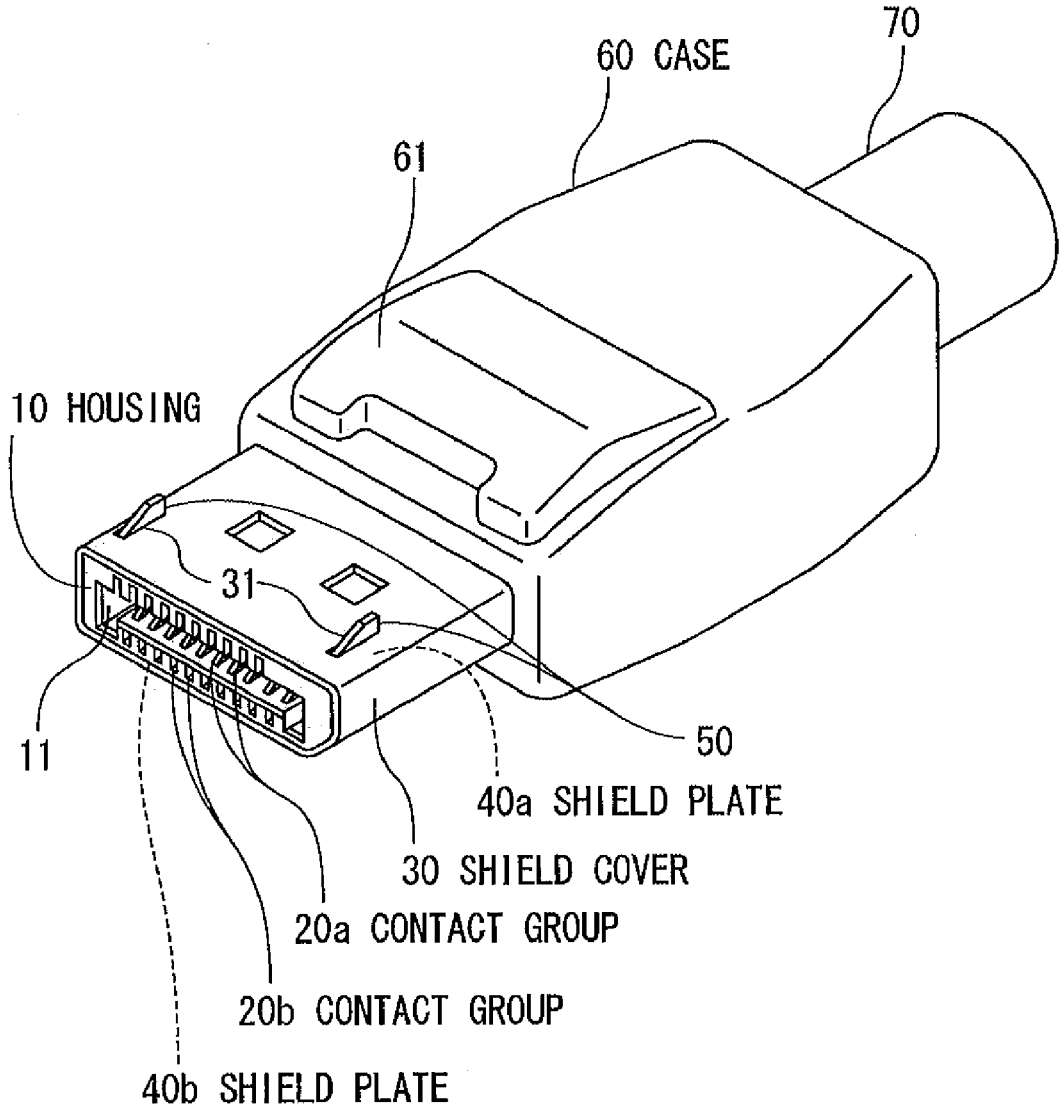
FIG. 1 illustrates an electric connector according to an embodiment of the present invention, showing a perspective view of the electric connector.
Figure 2:
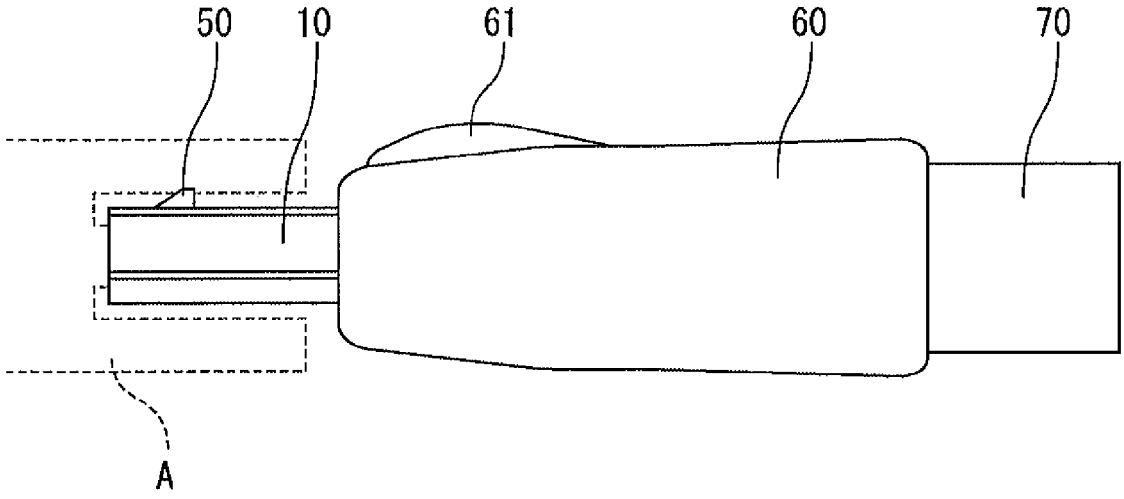
FIG. 2 is a side view of the electric connector.
Figure 3:
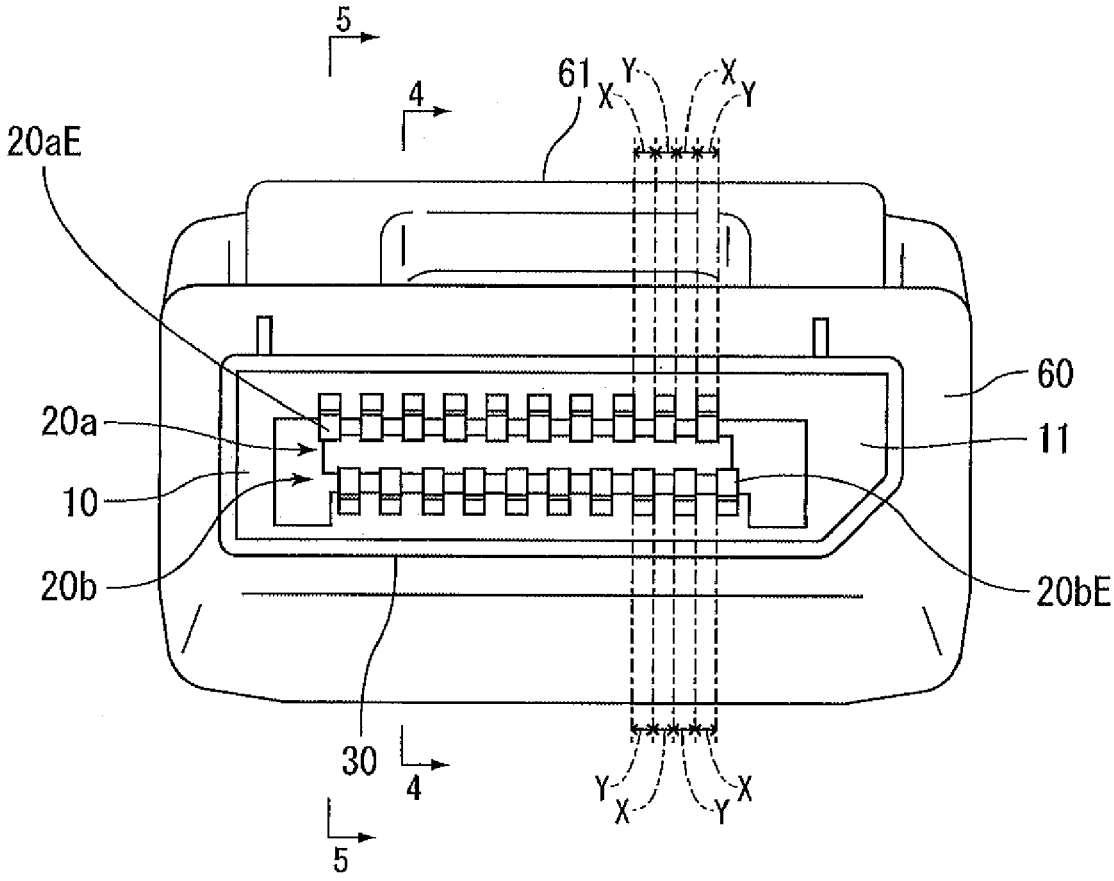
FIG. 3 is a plan view of the electric connector.
Figure 4:
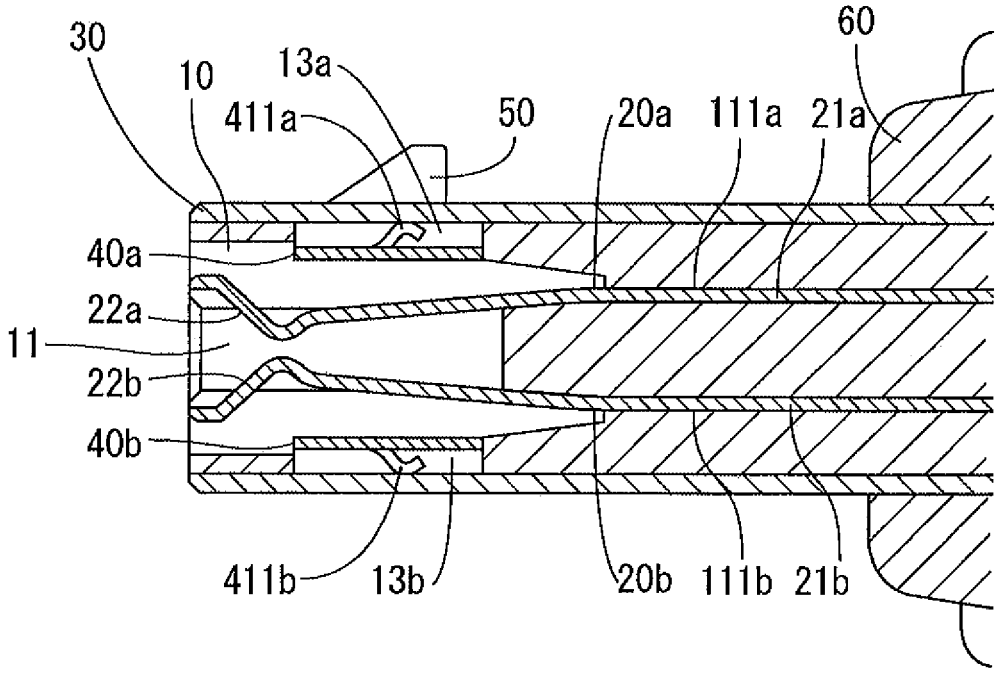
FIG. 4 is a partial longitudinal cross-sectional view of the electric connector, taken along the line 4-4 of GIG. 3.
Figure 5:
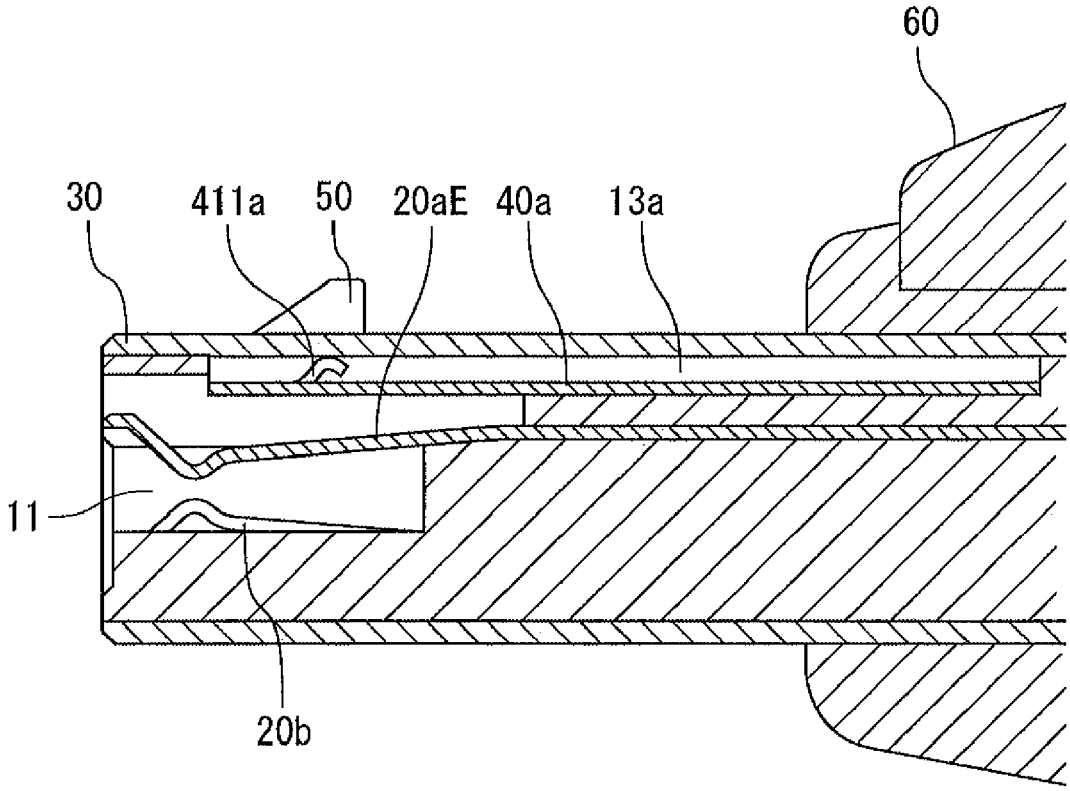
FIG. 5 is a partial longitudinal cross-sectional view of the electric connector, taken along the line 5-5 of GIG. 3.

The housing 10 is an insulative member made of plastics material in a substantially rectangular solid shape, with its front side adapted to be engaged with a mating connector A (see FIG. 2) which is provided in an electronic device and the like. As shown in FIGS. 1 and 3, the housing 10 accommodates the contact groups 20*a* and 20*b*, which are laterally arranged in two rows shifted in phase from each other so as to correspond to contacts (not shown) of the mating connector A. As shown in FIGS. 4 and 5, an opening 11 to receive a protruded portion at a leading end of the mating connector A is provided in a front center of the housing 10. The housing 10 has, in the back of the opening 11, terminal insertion holes 111*a* and 111*b* formed on the upper and lower sides, respectively.

A total of ten contacts constitute the contact group 20*a*. Each of the contacts is a generally straight linear plate-like metal terminal with a slightly curved leading end portion 22*a*. Its proximal end 21*a* is held and fixed in one of the terminal insertion hole 111*a* provided in the housing 10, while its leading end 22*a* is disposed fully out of the terminal insertion hole 111*a* and exposed into the opening 11. Contacts constituting the contact group 20*b* have exactly the same structures: their proximal ends 21*b* are held and fixed in the terminal insertion holes 111*b* provided in the housing 10 and their leading ends 22*b* are disposed fully out of the terminal insertion holes 111*b* and exposed into the opening 11.

In the contact group 20*a*, impedance tuning is performed on a contact 20*a*E (a particular contact) shown as the leftmost contact in FIG. 3. In the contact group 20*b*, impedance tuning is performed on a contact 20*b*E (a particular contact) shown as the rightmost contact in FIG. 3.

Figure 6:
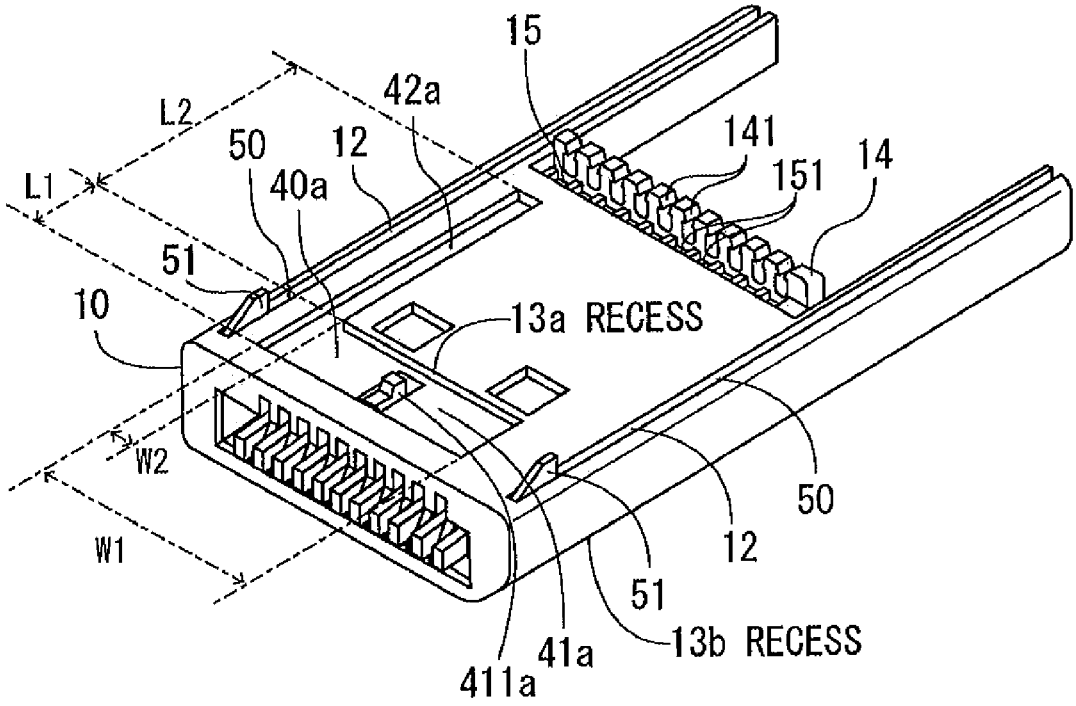
FIG. 6 is a perspective view of the electric connector with a case and a shield cover removed.
Figure 7:
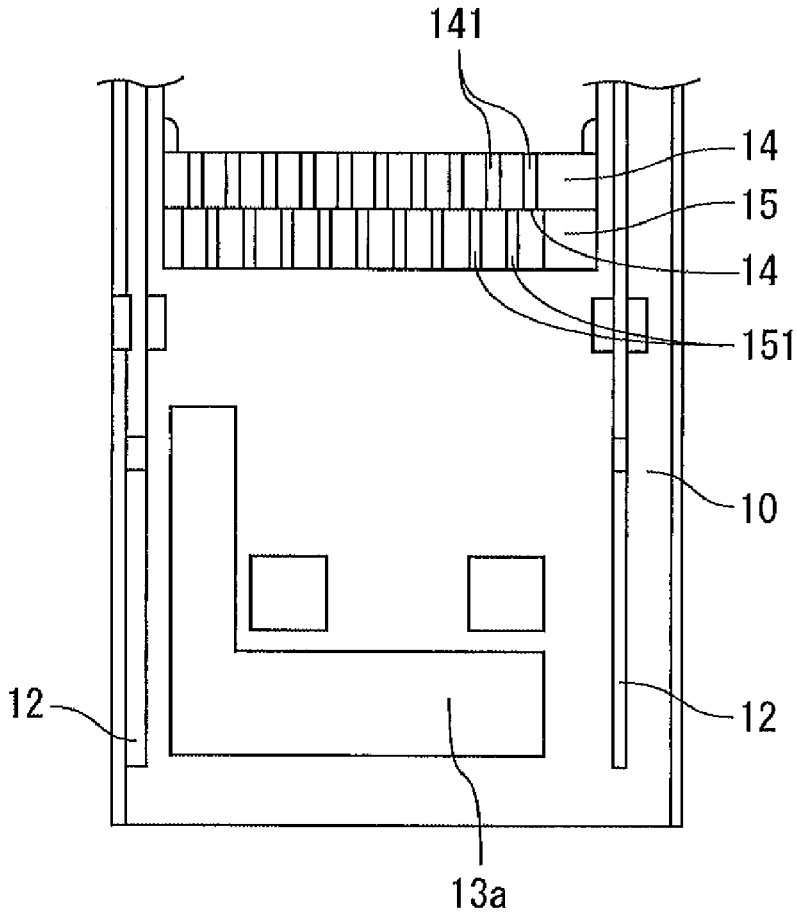
FIG. 7 is a partial plan view of a housing of the electric connector.

Lead terminals (not shown) at the rear ends of the contacts constituting the contact groups 20*a* and 20*b* are drawn from a rear end portion of the housing 10 to the outside and soldered to core lines (not shown) of the cable 70. For ease in the soldering work, a support 15 and a vertical wall 14 are provided on the rear end portion of the housing 10 as shown in FIGS. 6 and 7.

For the purpose of description, a contact-to-contact distance in the contact groups 20*a* and 20*b* is referred to herein as X, and the width of each contact is referred to as Y, as shown in FIG. 3.

The support 15 is a thin-plate-like member provided laterally on the rear end portion of the housing 10. On the upper surface of the support 15, there are laterally provided with grooves 151 to receive the lead terminals of the contacts constituting the contact group 20*a*. On the lower surface of the support 15, there are also laterally provided with grooves (not shown) to receive the lead terminals of the contacts constituting the contact group 20*b*. The vertical wall 14 is a thin-plate-like member that is provided along the rear edge of the support 15 and extends upward and downward. The upper end of the vertical wall 14 has lead insertion grooves 141 laterally arranged to temporarily hold the core lines (not shown) of the cable 70. Similarly, the lower end of the vertical wall 14 has lead insertion grooves (not shown) laterally arranged to temporarily hold the core lines (not shown) of the cable 70.

The housing 10 is provided on opposite widthwise ends with grooves 12 that extend longitudinally so as to receive and fit lock terminals 50. Each of the lock terminals 50 is a substantially U-shaped flexible metal member and is provided at its leading end with a pawl 51 to lock the mating connector A.

The housing 10 is provided in its upper and lower surfaces with recesses 13*a* and 13*b*, respectively, for containing and positioning the shield plates 40*a* and 40*b*. The recesses 13*a* and 13*b* have the same shapes and sizes as the shield plates 40*a* and 40*b* and have depths that are approximately equal to the thicknesses of the shield plates 40*a* and 40*b*.

The shield plates 40*a* and 40*b* are L-shaped metal plates used for impedance matching and are contained in the recesses 13*a* and 13*b*, respectively, of the housing 10 as described above. That is, in a state where the shield cover 30 is fitted around the housing 10, the shield plate 40*a* is disposed between the shield cover 30 and the contact group 20*a* and in face-to-face relationship with the contact group 20*a*, the shield plate 40*b* is disposed between the shield cover 30 and the contact group 20*b* and in face-to-face relationship with the contact group 20*b*. The shield plate 40*b* is shifted in position from the first shield plate 40*a* by the same distance as the phase shift between the first and second rows of contact groups 20*a* and 20*b*.

The shield plate 40*a* has a main portion 41*a* and an extended portion 42*a*. The main portion 41*a* has a width that corresponds to the lateral length of the contact group 20*a*, and the extended portion 42*a* extends perpendicularly from an end portion of the main portion 41*a*. The main portion 41*a* is provided with a spring member 411*a* that is contactable with an inner surface of the shield cover 30 when the shield plate 40*a* is contained in the recess 13*a*.

In the present embodiment, the spring member 411*a* is integrally provided with the main portion 41*a* by bending a portion of the main portion 41*a*. As shown in FIG. 6, the width W1 of the main portion 41*a* is set according to a result of calculation 11X+10Y, and the width W2 of the extended portion 42*a* is set according to a result of calculation 2X+Y. The length L1 of the main portion 41*a* is set approximately equal to the length of the leading ends 22*a* of the contacts constituting the contact group 20*a*. The length L2 of the extended portion 42*a* is appropriately determined depending on the condition of impedance mismatch of the contact 20*a*E, details of which follow.

When the shield plate 40*a* as described above is contained in the recess 13*a* of the housing 10, the main portion 41*a* is disposed in face-to-face and parallel relationship with each of the leading ends 22*a* of the contacts constituting the contact group 20*a*. The extended portion 42*a* is disposed in face-to-face relationship with the contact 20*a*E at the leftmost end in FIG. 3 among the contact group 20*a*. This means that the shield plate 40*a* changes in length in an insertion direction of the mating connector along the width thereof, and the length (L1+L2) of a portion of the shield plate facing the contact 20*a*E is different from the length (L1) of the remaining portion of the shield plate facing the other contacts in the contact group 20*a*. Consequently, the shield plate 40*a* has a larger area overlapping the contact 20*a*E in plane position, by the area of the extending portion 42*a*, than each of the other areas overlapping the other contacts.

The shield plate 40*b* is exactly the same in shape and other configuration as the shield plate 40*a*. More particularly, the shield plate 40*b* changes in length in an insertion direction of the mating connector along the width thereof, and the length of a portion of the shield plate facing the contact 20*b*E is different from the length of the remaining portion of the shield plate facing the other contacts in the contact group 20*b*. Consequently, the shield plate 40*b* has a larger area overlapping the contact 20*b*E (not shown) in plane position than each of the other areas overlapping the other contacts. The length of the extended portion 42*b* is appropriately determined depending on the condition of impedance mismatch of the contact 20*b*E, in a similar manner to the extended portion 42*a*.

As shown in FIGS. 1 to 5, the shield cover 30 is a rectangular-solid-shaped shell that covers the outer peripheral surfaces of the housing 10. Holes 31 are provided at both sides toward a leading end of an upper surface of the shield cover 30, to pass therethrough leading ends of the lock terminals 50.

The case 60 is a molded member of plastics material for mainly protecting the proximal end of the shield cover 30. The case 60 is provided on its upper surface with a push button 61 for switching between lock and release states relative to the mating connector A. That is, the push button 61 is coupled to the proximal ends of the lock terminals 50 inside the case 60, so that the pawls 51 of the lock terminals 50 are moved up and down.

In the electric connector constructed as described above, because the main portions 41*a* and 41*b* of the shield plates 40*a* and 40*b* are disposed in face-to-face relationship with the leading ends 22*a* and 22*b* of the contacts constituting the contact groups 20*a* and 20*b*, capacitance at the leading ends 22*a* and 22*b* of the contacts can be increased up to an approximately equal level to capacitance at the proximal ends 21*a* and 21*b* of the contacts.

Of the contacts constituting the contact group 20*a*, the contact 20*a*E is located at the lateral end and does not face the contact group 20*b*. Therefore, the contact 20*a*E should hold smaller capacitance than the other contacts. Similarly, since the contact 20*b*E is at a lateral end of the contacts constituting the contact group 20*b* and does not face the contact group 20*a*, the contact 20*b*E should hold smaller capacitance than the other contacts.

However, these contacts 20*a*E and 20*b*E are disposed parallel to the extended portion 42*a* and 42*b*, respectively, of the shield plate 40*a* and 40*b* with the housing 10 interposed in between, so that the capacitance of the contacts 20*a*E and 20*b*E is increased up to a level approximately equal to capacitance of the other contacts.

Accordingly, it is possible to provide impedance matching with high accuracy with respect to the contact groups 20*a* and 20*b*, resulting in improved transmission characteristics of the connector.

Figure 8:
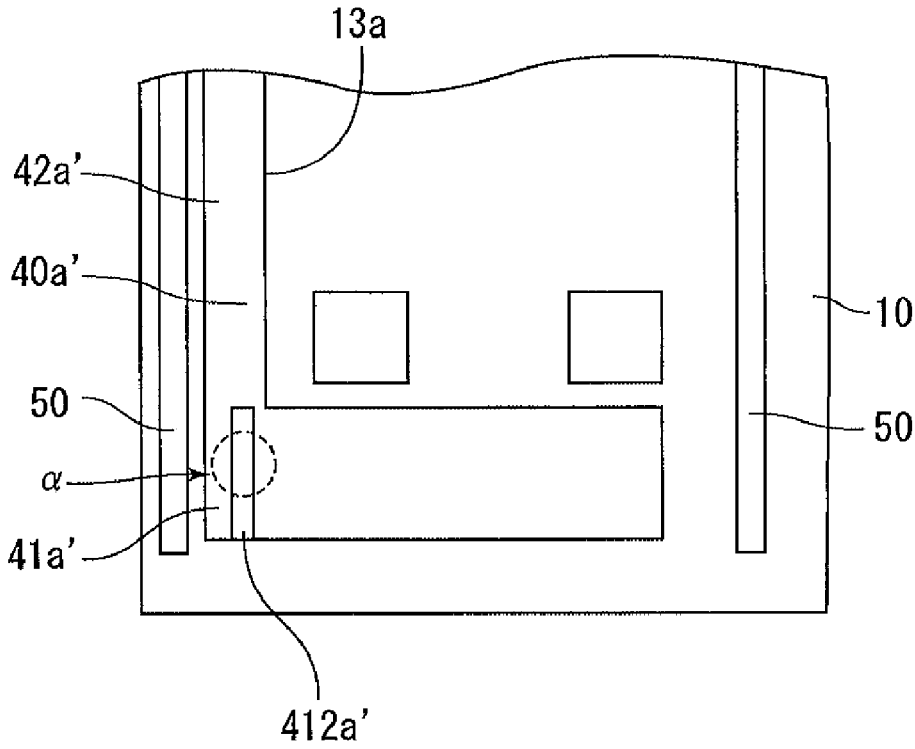
FIG. 8 illustrates a modification of the electric connector according to the present invention, showing a partial plan view of the electric connector with the case and the shield cover removed.
Figure 9:
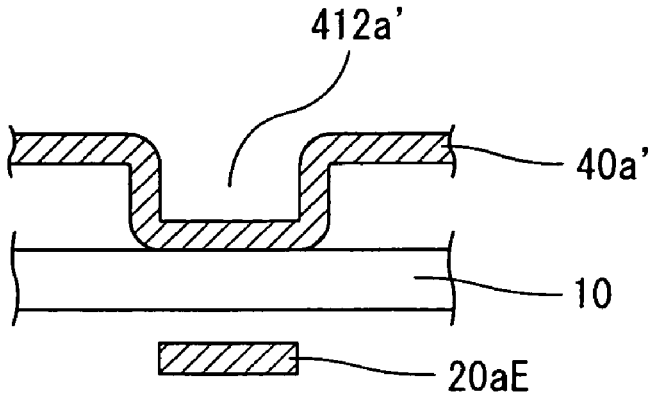
FIG. 9 is a cross-sectional view of a portion α in FIG. 8, showing a positional relationship between a shield plate and a contact.

In this regard, impedance matching with higher accuracy can be further pursued by using a shield plate 40*a*' as shown in FIGS. 8 and 9. The shield plate 40*a*' includes a main portion 41*a*' and an extended portion 42*a*' that are similar to those of the shield plate 40*a*, but the shield plate 40*a*' is different from the shield plate 40*a* in that the main portion 41*a*' has a lowered portion 412*a*' located to face the contact 20*a*E. It should be noted that a spring member provided in the main portion 41*a*' is not shown in FIG. 8.

In this configuration, the shield plate 40*a*' changes in height position along the width thereof, and the lowered portion 412*a*' (a portion facing the contact 20*a*E) is formed at a lower position than the remaining portion (the portion facing the other contacts). The distance from the lowered portion 412*a*' to the contact 20*a*E is smaller than the distance from the remaining portion of the shield plate 40*a*' to the other contacts of the contact group 20*a*, resulting in the increased capacitance at the contact 20*a*E. That is, impedance of the contact 20*a*E can be finely tuned depending on the depth of the lowered portion 412*a*' of the shield plate 40*a*'. In this case, the shield plate 40*b* may be similarly modified to have a lowered portion in the main portion 41*b* located to face the contact 20*b*E, but the detailed description of the configuration will not be repeated here.

Moreover, the shield plates 40*a* and 40*b* are positioned by and contained in the recessed 13*a* and 13*b* of the housing 10, which greatly facilitates attachment of the shield plate 40*a* and 40*b*. Further, since the shield plate 40*a* and 40*b* have the spring members 411*a* and 411*b*, electrical conduction is established between the shield cover 30 and the shield plates 40*a* and 40*b*, respectively, just by fitting the shield cover 30 around the housing 10, and no special wiring operation is necessary. As such, the connector as a whole can be assembled easily. This construction, including the advantageous feature that no other components need to be prepared than the shield plates 40*a* and 40*b*, contributes to cost reduction.

Figure 10:
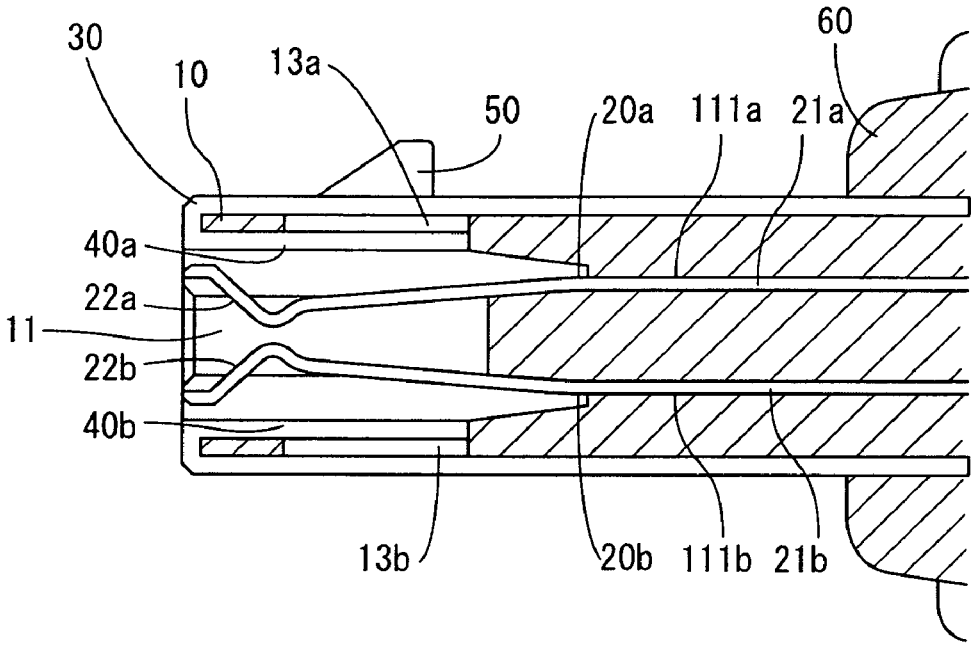
FIG. 10 is a partial longitudinal cross-sectional view of an electric connector according to an embodiment of the present invention.

For further cost reduction, the shield plates 40*a* and 40*b* may be integrated with the shield cover 30. More particularly, the upper and lower portions of the shield cover 30 may be partly extended frontward and bent inward so as to use these bent portions as substitutes for the shield plates 40*a* and 40*b*, respectively, as illustrated in FIG. 10, for example. In this case, reduction in the number of components leads to reduced costs.

The electric connector of the invention is also applicable to connectors of other types, e.g., an HDMI cable plug, a display port cable connector, and a multiple-pin cable plug with a two-row contact configuration. That is, the type, geometry, the number of pins of the contacts and arrangement thereof, etc. are not limited to those described in the above embodiment. The connector is also applicable to a receptacle connector.

The housing may be appropriately changed in design depending on its applications, as long as it is an insulative member shaped such as to be engageable on a front side thereof with a mating connector, and as long as the proximal ends of the contacts being held and fixed in terminal insertion holes formed in the housing and the leading ends of the contacts being exposed from the terminal insertion holes.

Any shape can be adopted for the contacts, and the way of taking out the lead portions may also be suitably changed in design depending on the applications. The shield cover may have any shape etc. as long as it surrounds the outer surfaces of the housing.

The shield plates may have any shape etc. and may be fixed in any manner, as long as they are metal plates, with their widths corresponding to the lateral lengths of the contact groups, and as long as the shield plates are disposed between the shield cover and the contact groups and face the contact groups.

In particular, depending on the position etc. of the contact subject to impedance tuning, the extended portions 42*a* and 42*b* shown in FIG. 6 or the dropped portions 412*a*' etc. shown in FIG. 8 may be suitably changed in design, e.g. in position. There may be a case in which capacitance of the particular contact has to be reduced in comparison with the other contacts, depending on the arrangement of the contact groups; in such a case, an associated portion of the shield plate may be cut away or be raised.

What is claimed is:

1. An electric connector comprising:

an insulative housing of such a shape as to be engageable on a front side thereof with a mating connector;

a contact group including a plurality of contacts, the contacts being arranged in a widthwise direction of the connector so as to correspond to contacts of the mating connector, proximal ends of the contacts being held and fixed in terminal insertion holes formed in the housing and leading ends of the contacts being exposed from the terminal insertion holes, the contacts including a particular contact, being located at an outer end of the contact group and subject to impedance tuning, and other contacts;

a shield cover for surrounding outer surfaces of the housing; and a metal shield plate of substantially L shape being disposed between the shield cover and the contact group, the metal shield plate including:

a main portion, having a width corresponding to a lateral length of the contact group and being disposed to face the contact group; and an extended portion, extending perpendicularly from a widthwise end of the main portion and along the particular contact, the extending portion facing the particular contact and having a length in accordance with a degree of impedance tuning of the particular contact.

2. The electric connector according to claim 1, the contact group comprising first and second rows of contacts shifted in phase, the shield plate comprising:

a first shield plate, facing the first row of contacts, and a second shield plates, facing the second row of contacts and being shifted in position from the first shield plate by the same distance as the phase shift between the first and second rows of contacts.

3. The electric connector according to claim 1, wherein the shield cover is contactable with an outer peripheral shield of the mating connector when the mating connector is engaged with the housing.

4. The electric connector according to claim 1, wherein a recess is provided on an outer surface of the housing to contain and position the shield plate.

5. The electric connector according to claim 4, wherein the shield plate is provided with a spring member, the spring member being contactable with an inner surface of the shield cover when the shield plate is contained in the recess.

6. The electric connector according to claim 1, wherein the shield plate is integrated with the shield cover, formed by extending and bending a portion of the shield cover.

7. An electric connector comprising:

an insulative housing of such a shape as to be engageable on a front side thereof with a mating connector;

a contact group including a plurality of contacts, the contacts being arranged in a widthwise direction of the connector so as to correspond to contacts of the mating connector, proximal ends of the contacts being held and fixed in terminal insertion holes formed in the housing and leading ends of the contacts being exposed from the terminal insertion holes, the contacts including a particular contact, subject to impedance tuning, and other contacts;

a shield cover for surrounding outer surfaces of the housing; and a metal shield plate being disposed between the shield cover and the contact group, the metal shield plate including:

a main portion, having a width corresponding to a lateral length of the contact group and facing the contact group; and a lowered portion which is a part of the main portion being bent in a U shape toward the particular contact, a height of the lowered portion being adjusted in accordance with a degree of impedance tuning of the particular contact.

8. The electric connector according to claim 7, the contact group comprising first and second rows of contacts shifted in phase, the shield plate comprising:

a first shield plate, facing the first row of contacts, and a second shield plates, facing the second row of contacts and being shifted in position from the first shield plate by the same distance as the phase shift between the first and second rows of contacts.

9. The electric connector according to claim 7, wherein the shield cover is contactable with an outer peripheral shield of the mating connector when the mating connector is engaged with the housing.

10. The electric connector according to claim 7, wherein a recess is provided on an outer surface of the housing to contain and position the shield plate.

* * * * *